US009300095B2

(12) United States Patent
Lin et al.

(10) Patent No.: US 9,300,095 B2
(45) Date of Patent: Mar. 29, 2016

(54) ELECTRICAL CONNECTOR

(71) Applicant: LOTES CO., LTD, Keelung (TW)

(72) Inventors: Chin Chi Lin, Keelung (TW); Ted Ju, Keelung (TW); Zhi Guo Peng, Keelung (TW)

(73) Assignee: LOTES CO., LTD, Keelung (TW)

( * ) Notice: Subject to any disclaimer, the term of this patent is extended or adjusted under 35 U.S.C. 154(b) by 0 days.

(21) Appl. No.: 14/621,162

(22) Filed: Feb. 12, 2015

(65) Prior Publication Data

US 2015/0244118 A1 Aug. 27, 2015

Related U.S. Application Data

(60) Provisional application No. 61/942,830, filed on Feb. 21, 2014.

(51) Int. Cl.

| | |
|---|---|
| ***H01R 13/648*** | (2006.01) |
| ***H01R 24/60*** | (2011.01) |
| ***H01R 13/426*** | (2006.01) |
| ***H01R 13/6585*** | (2011.01) |

(52) U.S. Cl.
CPC ..... *H01R 24/60* (2013.01); *H01R 13/426* (2013.01); *H01R 13/6585* (2013.01)

(58) Field of Classification Search
CPC ..... H01R 13/65802; H01R 23/6873; H01R 13/6581; H01R 13/6593; H01R 13/506; H01R 13/514; H01R 13/6582
USPC ..... 439/607.27, 607.4, 607.24, 607.41
See application file for complete search history.

(56) References Cited

U.S. PATENT DOCUMENTS

| | | | | |
|---|---|---|---|---|
| 7,758,379 | B2 * | 7/2010 | Chen | H01R 13/6485 439/607.11 |
| 8,684,769 | B2 * | 4/2014 | Kao | H01R 13/6471 439/607.28 |
| 8,808,029 | B2 * | 8/2014 | Castillo | H01R 13/6585 439/607.05 |
| 8,968,031 | B2 * | 3/2015 | Simmel | H01R 13/659 439/108 |

* cited by examiner

*Primary Examiner* — Xuong Chung Trans
(74) *Attorney, Agent, or Firm* — Locke Lord LLP; Tim Tingkang Xia, Esq.

(57) ABSTRACT

An electrical connector for mating with a mating connector having a metal elastic sheet. The electrical connector includes an insulating body, a middle shielding sheet and a metal casing. The insulating body includes a base, a tongue extending forward from the base, and an upper row and a lower row of terminals. Each upper and lower row terminals has a contact portion exposed from upper and lower surfaces of the tongue respectively. The middle shielding sheet is disposed in the tongue and located between the upper row and lower row of terminals. The middle shielding sheet includes a groove exposed from a side of the tongue, for being buckled by the metal elastic sheet to stop forward displacement of the metal elastic sheet. The metal casing wraps a periphery of the insulation body to form a mating cavity, for the mating connector to be entered therein.

10 Claims, 5 Drawing Sheets

ELECTRICAL CONNECTOR

CROSS-REFERENCE TO RELATED APPLICATION

This application claims priority to and the benefit of, pursuant to 35 U.S.C. §119(e), U.S. provisional patent application Ser. No. 61/942,830, filed Feb. 21, 2014, entitled "ELECTRICAL CONNECTOR," by Chin Chi Lin, which is incorporated herein in its entirety by reference.

Some references, if any, which may include patents, patent applications and various publications, may be cited and discussed in the description of this invention. The citation and/or discussion of such references, if any, is provided merely to clarify the description of the present invention and is not an admission that any such reference is "prior art" to the invention described herein. All references listed, cited and/or discussed in this specification are incorporated herein by reference in their entireties and to the same extent as if each reference was individually incorporated by reference.

FIELD OF THE INVENTION

The present invention relates to an electrical connector, and more particularly to an electrical connector which prevents buckling abrasion.

BACKGROUND OF THE INVENTION

Main elements forming an electrical connector are an insulation body, and multiple terminals disposed in the insulation body. Further, in order to achieve a function of shielding, bonding or protecting, some electrical connectors are wrapped with a metal casing outside the insulation body. In order to cooperatively fix an electrical connector with a mating connector, a snap-fit slot or snap-fit portion is normally disposed at the insulation body, and a disposing structure is disposed at the mating connector for being buckled to the snap-fit slot or snap-fit portion. Because the mating connector and the insulation body are both made of plastic material, abrasion easily occurs after the mating connector and the insulation body are cooperatively fixed multiple times, resulting in unstable snap-fit between the mating connector and the insulation body. When the mating connector is made of metal material, more severe abrasion occurs in the snap-fit slot or snap-fit portion because of the cooperation between the metal material and the plastic material.

In addition to the foregoing snap-fit manner, a common snap-fit manner in the industry is as follows: a metal elastic sheet is disposed on a metal casing, and a corresponding mating connector is provided with a snap-fit slot and made of a metal material. The snap-fit manner solves the problem that abrasion causes unstable snap-fit, but because the metal elastic sheet is disposed on the metal casing, a hole or slot is inevitably provided correspondingly. As signal transmission of electronic elements is increasingly faster currently, a high frequency problem needs to be considered for an electrical connector. Generally in order to solve the high frequency problem, the metal casing is not provided with any hole or slot as much as possible, so as to prevent signal interference, which affects high frequency performance of the electrical connector.

Therefore, a heretofore unaddressed need exists in the art to address the aforementioned deficiencies and inadequacies.

SUMMARY OF THE INVENTION

In one aspect, the present invention is directed to an electrical connector which achieves abrasion prevention and stable snap-fit and fixing by means of buckling between a middle shielding sheet and a mating connector.

In one embodiment, an electrical connector is used for mating with a mating connector. The mating connector has at least one metal elastic sheet. The electrical connector includes an insulating body, an upper row of terminals and a lower row of terminals, a middle shielding sheet, and a metal casing. The insulating body has a base and a tongue extending forward from the base. The upper row of terminals and the lower row of terminals are disposed in the insulating body. Each of the upper row of terminals has a contact portion exposed from an upper surface of the tongue, and each of the lower row of terminals has a contact portion exposed from a lower surface of the tongue. The middle shielding sheet is disposed in the tongue and located between the upper row of terminals and the lower row of terminals. The middle shielding sheet includes at least one groove exposed from a side of the tongue, and the groove is buckled by the metal elastic sheet to stop forward displacement of the metal elastic sheet. The metal casing wraps a periphery of the insulation body, and a mating cavity is formed in a peripheral space of the tongue. The mating connector enters the mating cavity.

In one embodiment, the tongue is further includes a front surface and two side surfaces located between the upper surface and the lower surface. The middle shielding sheet has a plate portion fixed in the tongue, and an extending portion extends out of the side surface from a side of the plate portion. The groove is disposed at the extending portion and located outside the tongue. The extending portion and the groove are both located in the mating cavity. Each extending portion is disposed at one of two sides of the plate portion. The two extending portions symmetrically extend out of the two side surfaces, and the corresponding two grooves are located outside the tongue.

In one embodiment, the tongue includes a snap-fit slot corresponding to the groove. The groove has a buckling wall close to the front of the middle shielding sheet, and exposed from the snap-fit slot. The metal elastic sheet buckles to the buckling wall, and partially locates in the snap-fit slot and the groove. The buckling wall stops forward displacement of the metal elastic sheet. An outline of an inner wall of the groove is the same as that of an inner wall of the snap-fit slot.

In one embodiment, the groove has a buckling wall close to the front of the middle shielding sheet. The buckling wall is arc-shaped and is used for the metal elastic sheet to be buckled thereto. The buckling wall stops forward displacement of the metal elastic sheet.

In one embodiment, the tongue further includes a front surface and two side surfaces located between the upper surface and the lower surface. The middle shielding sheet has a plate portion fixed in the tongue, and at least one protecting portion extends out of the front surface from the plate portion.

In one embodiment, the electrical connector further includes an upper shielding sheet and a lower shielding sheet, respectively laminated to the upper surface and the lower surface of the tongue. The upper shielding sheet and the lower shielding sheet are mounted and connected to each other using two snap-fit structures. The middle shielding sheet has a notch corresponding to each of the two snap-fit structures, and the notch reserves space for the corresponding snap-fit structure.

In one embodiment, a mounting portion is disposed at a rear segment of the middle shielding sheet for being fixed in the base. The width of the mounting portion is greater than the width of the tongue.

In one embodiment, the tongue further includes a front surface and two side surfaces located between the upper surface and the lower surface. The middle shielding sheet has a plate portion fixed in the tongue. The groove is provided at the plate portion and located in the tongue. The groove does not exceed the side surfaces.

Compared with the related art, in certain embodiments of the present invention, the groove disposed on the middle shielding sheet is exposed from a side of the tongue. Both the middle shielding sheet and the metal elastic sheet are made of metal material. When the mating connector enters the mating cavity, the metal elastic sheet and the groove are fixed in a snap-fit manner, which ensures stable buckling between the mating connector and the electrical connector, and prevents abrasion problem.

Additionally, in such a snap-fit manner described above, the metal casing of the electrical connector does not need to be particularly provided with a snap-fit elastic sheet. Therefore, the shielding effect can be ensured. Meanwhile, the middle shielding sheet is disposed to further isolate the upper row of terminals from the lower row of terminals, thereby preventing signal interference between terminals.

These and other aspects of the present invention will become apparent from the following description of the preferred embodiment taken in conjunction with the following drawings, although variations and modifications therein may be effected without departing from the spirit and scope of the novel concepts of the disclosure.

BRIEF DESCRIPTION OF THE DRAWINGS

The accompanying drawings illustrate one or more embodiments of the invention and together with the written description, serve to explain the principles of the invention. Wherever possible, the same reference numbers are used throughout the drawings to refer to the same or like elements of an embodiment.

DETAILED DESCRIPTION OF THE INVENTION

Figure 1:
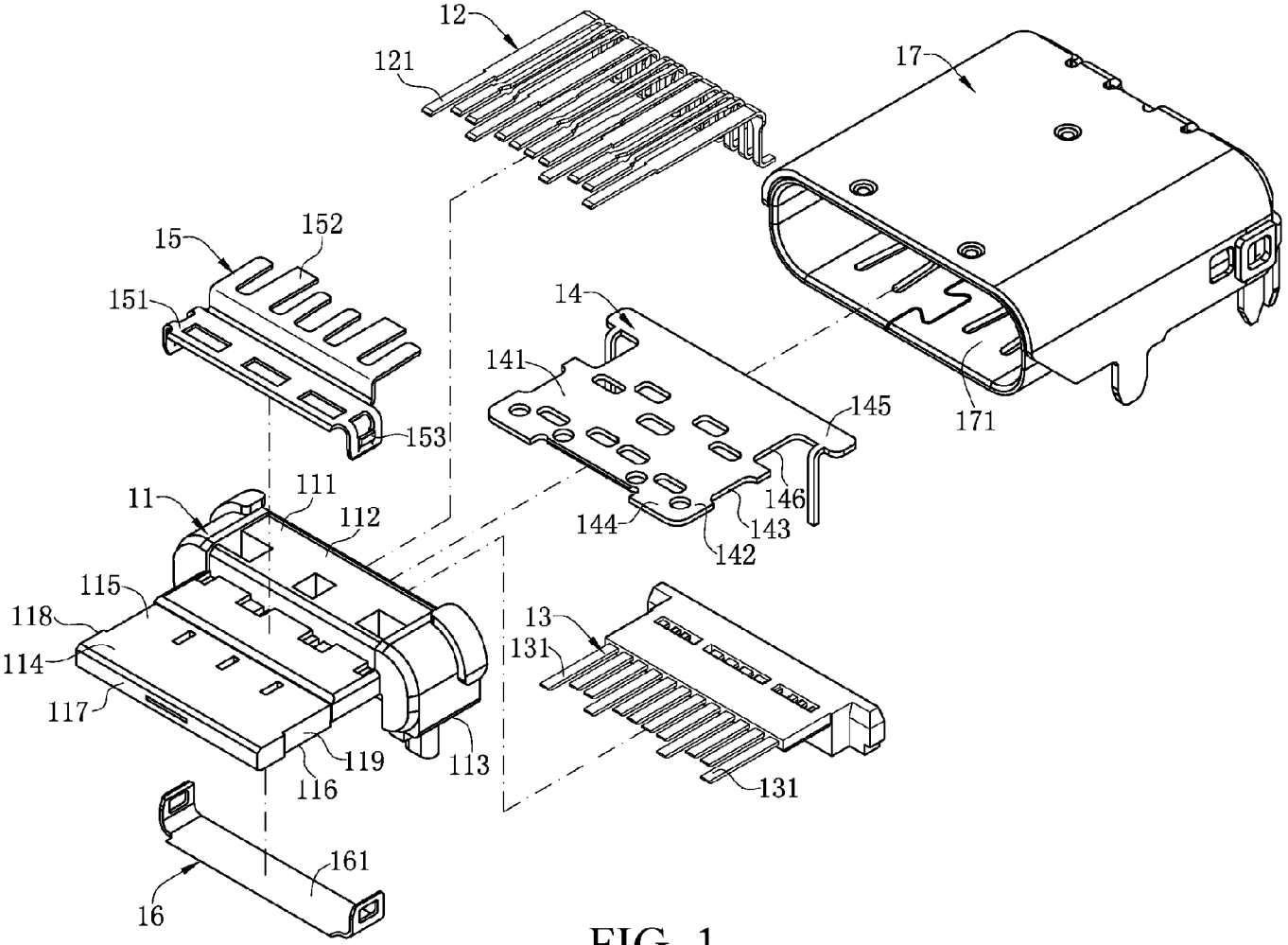
FIG. 1 is a schematic exploded view of an electrical connector according to one embodiment of the present invention.

The present invention is more particularly described in the following examples that are intended as illustrative only since numerous modifications and variations therein will be apparent to those skilled in the art. Various embodiments of the invention are now described in detail. Referring to the drawings, like numbers indicate like components throughout the views. As used in the description herein and throughout the claims that follow, the meaning of "a", "an", and "the" includes plural reference unless the context clearly dictates otherwise. Also, as used in the description herein and throughout the claims that follow, the meaning of "in" includes "in" and "on" unless the context clearly dictates otherwise. Moreover, titles or subtitles may be used in the specification for the convenience of a reader, which shall have no influence on the scope of the present invention.

It will be understood that when an element is referred to as being "on" another element, it can be directly on the other element or intervening elements may be present therebetween. In contrast, when an element is referred to as being "directly on" another element, there are no intervening elements present. As used herein, the term "and/or" includes any and all combinations of one or more of the associated listed items.

Furthermore, relative terms, such as "lower" or "bottom" and "upper" or "top," may be used herein to describe one element's relationship to another element as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on "upper" sides of the other elements. The exemplary term "lower", can therefore, encompasses both an orientation of "lower" and "upper," depending of the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

As used herein, "around", "about" or "approximately" shall generally mean within 20 percent, preferably within 10 percent, and more preferably within 5 percent of a given value or range. Numerical quantities given herein are approximate, meaning that the term "around", "about" or "approximately" can be inferred if not expressly stated.

As used herein, the terms "comprising", "including", "carrying", "having", "containing", "involving", and the like are to be understood to be open-ended, i.e., to mean including but not limited to.

The description will be made as to the embodiments of the present invention in conjunction with the accompanying drawings in FIGS. 1-5. In accordance with the purposes of this invention, as embodied and broadly described herein, this invention, in one aspect, relates to an electrical connector.

Figure 4:
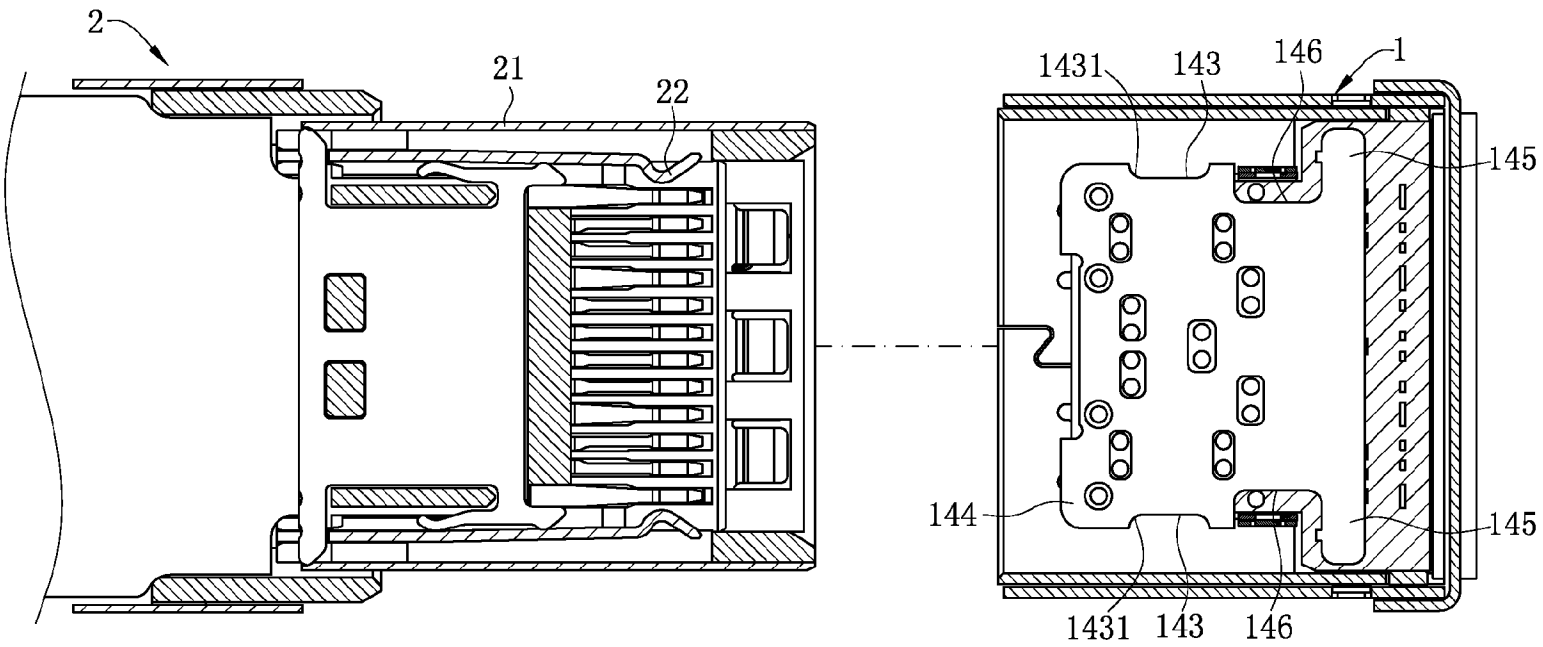
FIG. 4 is a sectional view obtained before the electrical connector mates with the mating connector according to one embodiment of the present invention.

As shown in FIG. 4, an electrical connector 1 according to one embodiment of the present invention is used for mating with a mating connector 2. The mating connector 2 has an insertion portion 21. Two metal elastic sheets 22 are disposed at two sides of the insertion portion 21. In other embodiments, the mating connector 2 may has only one or more than two metal elastic sheets 22.

Figure 2:
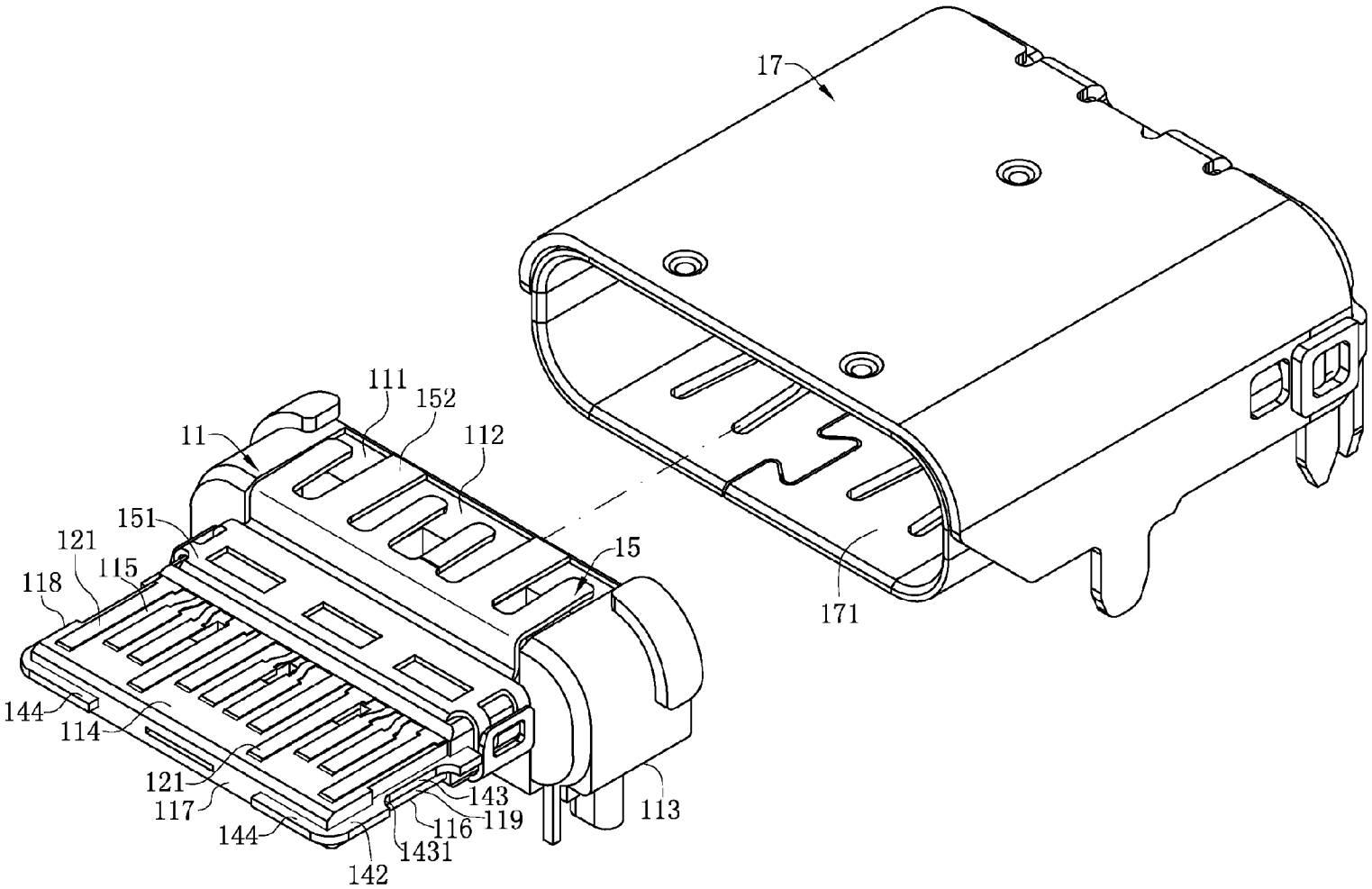
FIG. 2 is a schematic view of separating a shielding casing from the electrical connector according to one embodiment of the present invention.

As shown in FIG. 1 and FIG. 2, the electrical connector 1 includes an insulation body 11, an upper row of terminals and a lower row of terminals 12/13 fixed to the insulation body 11, a middle shielding sheet 14 disposed in the insulation body 11 and located between the upper row of terminals 12 and the lower row of terminals 13, an upper shielding sheet 15 and a lower shielding sheet 16 respectively located on the top and the bottom of the insulation body 11, and a metal casing 17 wraps the periphery of the insulation body 11.

As shown in FIG. 1, the insulation body 11 includes a base 111 and a tongue 114 extending forward from the base 111. The base 111 has a top surface 112 and a bottom surface 113 disposed opposite to each other. The tongue 114 has an upper surface 115 and a lower surface 116 disposed opposite to each other, and a front surface 117 and two side surfaces 118 located between the upper surface 115 and the lower surface 116. A snap-fit slot 119 is provided on each of the two side surfaces 118, and the metal elastic sheet 22 is used for being partially located in the snap-fit slot 119. In other embodiments, an inner wall of the snap-fit slot 119 is formed by multiple consecutive arc-shaped walls (not shown). In one embodiment, the snap-fit slot 119 is only provided on one of the side surfaces 118. In one embodiment, the snap-fit slot 119 is provided on neither of the two side surfaces 118.

As shown in FIG. 1 and FIG. 2, each terminal of the upper row of terminals 12 has a contact portion 121 exposed from the upper surface 115 of the tongue 114, and each terminal of the lower row of terminals 13 has a contact portion 131 exposed from the lower surface 116 of the tongue 114.

Figure 3:
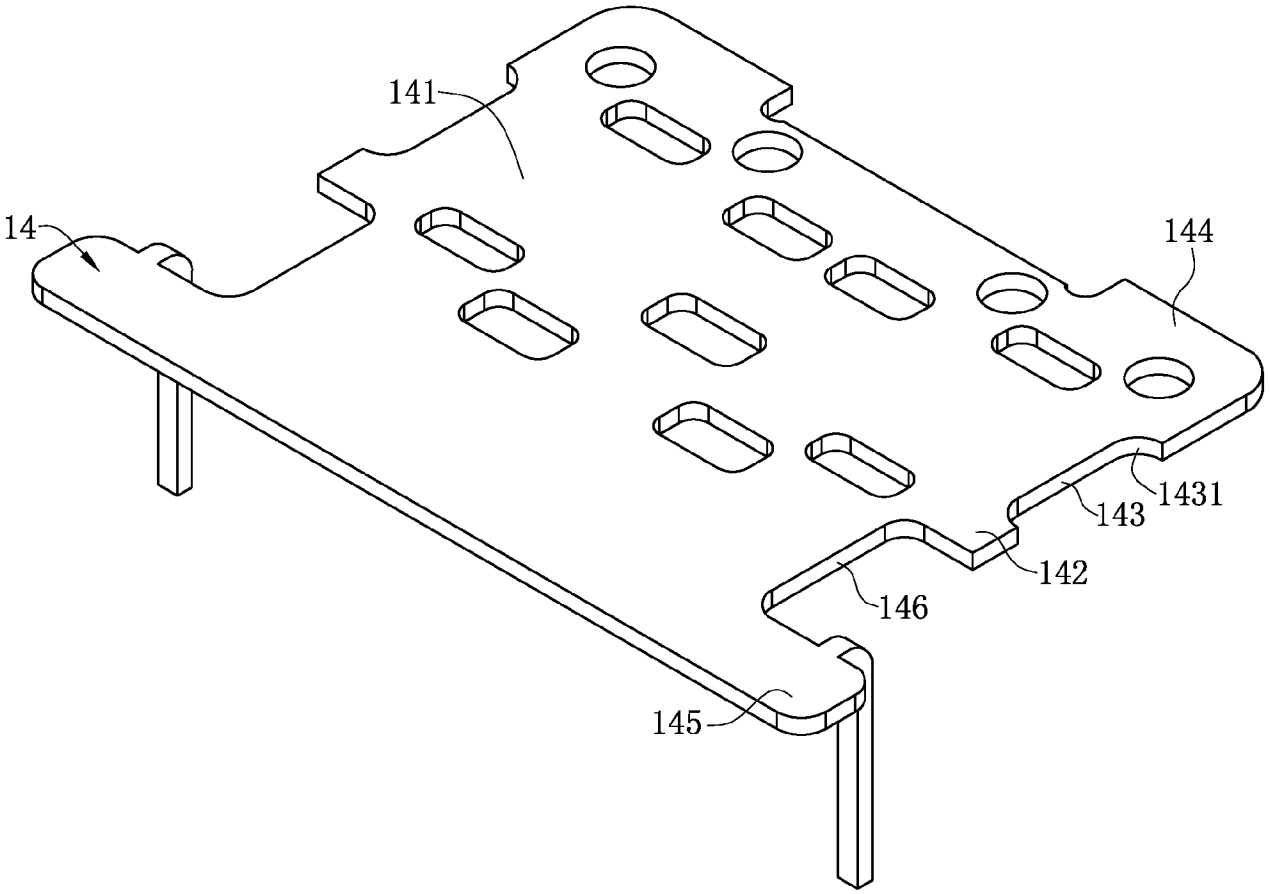
FIG. 3 is a schematic view of a middle shielding sheet according to one embodiment of the present invention.

As shown in FIG. 1 to FIG. 3, the middle shielding sheet 14 has a plate portion 141 fixed in the tongue 114. Extending portions 142 symmetrically extend from each of two sides of the plate portion 141, and each of the extending portions 142 is exposed from a side of the tongue 114. Each of the extending portions 142 is provided with a groove 143. The groove 143 is used for the metal elastic sheet 22 to be buckled thereto to stop displacement of the metal elastic sheet 22 toward the front surface 117. The groove 143 has a buckling wall 1431 close to the front of the middle shielding sheet 14, and exposed from the snap-fit slot 119. The buckling wall 1431 is arc-shaped and is used for the metal elastic sheet 22 to be buckled thereto. The buckling wall 1431 stops displacement of the metal elastic sheet 22 toward the front surface 117. The two extending portions 142 extend out of the two side surfaces 118, and the two grooves 143 are located outside the tongue 114. In other embodiments, the extending portion 142 and the groove 143 are both located in the tongue 114, and only being exposed. That is, neither the extending portion 142 nor the groove 143 exceeds the side surface 118. An outline of an inner wall of the groove 143 is the same as that of the inner wall of the snap-fit slot 119. In one embodiment, there is only one extending portion 142 extends from the plate portion 141. In one embodiment, parts of the extending portion 142 and the groove 143 are located in the tongue 114, and parts of the extending portion 142 and the groove 143 are located outside the tongue 114. In one embodiment, the plate portion 141 of the middle shielding sheet 14 is fixed in the tongue 114, the groove 143 is disposed at the plate portion 141 and located in the tongue 114, and the groove 143 does not exceed the side surface 118. That is, the extending portion 142 is not provided, thereby saving the space of the mating cavity 171.

As shown in FIG. 2 to FIG. 4, two protecting portions 144 extend forward from the plate portion 141 and are exposed from the front surface 117. The two protecting portions 144 are separately close to the two side surfaces 118. A mounting portion 145 is disposed at a rear segment of the middle shielding sheet 14, for being fixed in the base 111. The width of the mounting portion 145 is greater than the width of the tongue 114. A notch 146 is provided at each of two sides of the plate portion 141 close to the mounting portion 145. In other embodiments, there is only one protecting portion 144 extends forward from the plate portion 141.

As shown in FIG. 1, FIG. 2 and FIG. 4, the upper shielding sheet 15 has a front segment 151 and a rear segment 152 which are connected to each other. The lower shielding sheet 16 has a front segment 161. The two front segments 151/161 are respectively laminated to the upper surface 115 and the lower surface 116 of the tongue 114. The rear segment 152 is laminated to the top surface 112 of the base 111. The tongue 114 and the base 111 are both attached by means of the front segments 151/161 and the rear segment 152, and therefore the shielding effect is better. The upper shielding sheet 15 and the lower shielding sheet 16 are mounted and connected to each other by using two snap-fit structures 153. The two snap-fit structures 153 are disposed at the front segments 151/161. The notch 146 reserves space for the corresponding snap-fit structure 153.

Figure 5:
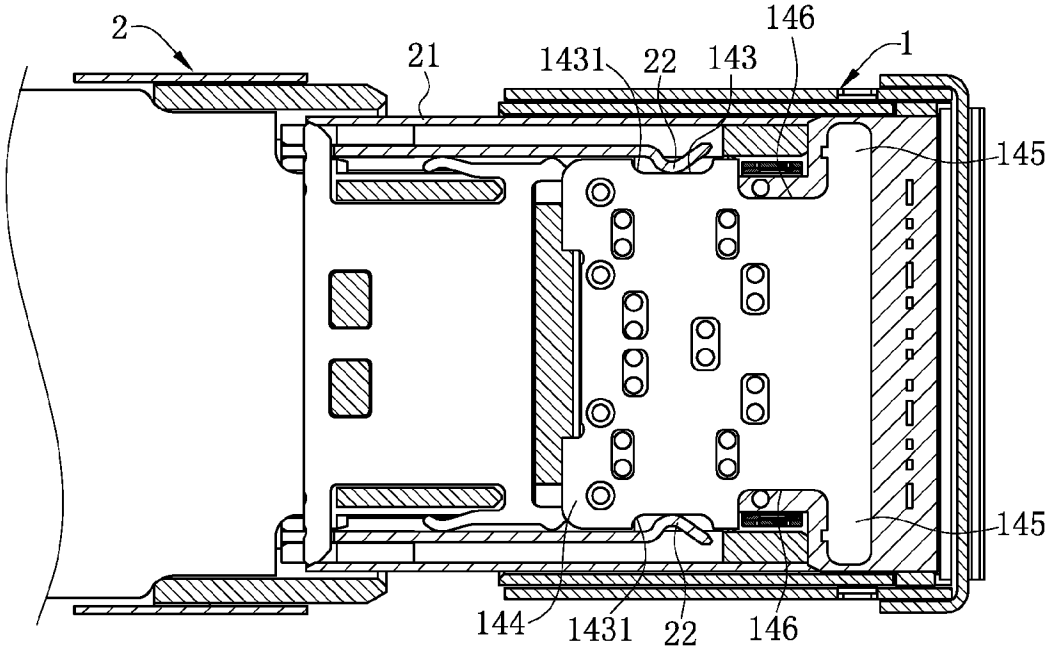
FIG. 5 is a sectional view obtained after the electrical connector mates with the mating connector according to the present invention.

As shown in FIG. 1 and FIG. 5, the metal casing 17 forms a mating cavity 171 in a peripheral space of the tongue 114. The extending portion 142, the groove 143 and the protecting portion 144 are all located in the mating cavity 171. The mating connector 2 enters the mating cavity 171, and then is buckled and fixed to the groove 143 and the snap-fit slot 119.

The electrical connector 1 according to certain embodiments of the present invention, among other things, has the following beneficial advantages.

1. The middle shielding sheet 14 has the two extending portions 142 exposed from the two side surfaces 118 of the tongue 114, and the grooves 143 are provided at the extending portions 142. The middle shielding sheet 14 and the metal elastic sheet 22 are both made of metal material. When the mating connector 2 enters the mating cavity 171, the metal elastic sheet 22 and the grooves 143 are fixed in a snap-fit manner, which ensures stable buckling between the mating connector 2 and the electrical connector 1, and prevent abrasion problems.

Further, in such a snap-fit manner described above, the metal casing 17 of the electrical connector 1 does not need to be particularly provided with a snap-fit elastic sheet, and therefore the shielding effect can be ensured. Meanwhile, the middle shielding sheet 14 is disposed to further isolate the upper row of terminals 12 from the lower row of terminals 13, thereby preventing signal interference between terminals.

2. The extending portion 142, the groove 143 and the protecting portion 144 are all located in the mating cavity 171. That is, the extending portion 142 and the groove 143 extend out of the side surface 118 of the tongue 114. Therefore, it is convenient for the mating connector 2 to enter the mating cavity 171 and snap-fit with the groove 143, the snap-fit strength is large, and it is not easy for the mating connector 2 to slide out.

The protecting portion 144 extends out of the front surface 117 of the tongue 114. When the mating connector 2 is mounted into the mating cavity 171, the front surface 117 of the tongue 114 can be protected from damage. Further, the two protecting portions 144 are respectively close to the two side surfaces 118. When the mating connector 2 is inserted askew or obliquely, the mating connector 2 may first contact the protecting portions 144, and avoid damaging the tongue 114.

3. The mounting portion 145 disposed at the rear segment of the middle shielding sheet 14 is fixed in the base 111, and the width of the mounting portion 145 is greater than the width of the tongue 114, which not only strengthens the base 111, but also isolates the upper row of terminals 12 and the lower row of terminals 13 located in the base 111 from signal interference.

4. The upper shielding sheet 15 and the lower shielding sheet 16 are mounted and connected to each other by two snap-fit structures 153. The two snap-fit structures 153 are disposed at the front segments 151/161. The notch 146 reserves space for the corresponding snap-fit structure 153. The front side of the notch 146 can prevent excessive forward displacement of the upper shielding sheet 15 and the lower shielding sheet 16.

5. The groove 143 is only exposed or is partially located in the tongue 114, and the outline of the inner wall of the groove 143 is the same as that of the inner wall of the snap-fit slot 119. Therefore the space of the mating cavity 171 can be saved, and it is also convenient for the metal elastic sheet 22 to be guided into the groove 143 and the snap-fit slot 119. The groove 143 and the snap-fit slot 119 jointly buckle and fix the metal elastic sheet 22 stably.

The foregoing description of the exemplary embodiments of the invention has been presented only for the purposes of illustration and description and is not intended to be exhaustive or to limit the invention to the precise forms disclosed. Many modifications and variations are possible in light of the above teaching.

The embodiments are chosen and described in order to explain the principles of the invention and their practical application so as to activate others skilled in the art to utilize the invention and various embodiments and with various modifications as are suited to the particular use contemplated. Alternative embodiments will become apparent to those skilled in the art to which the present invention pertains without departing from its spirit and scope. Accordingly, the scope of the present invention is defined by the appended claims rather than the foregoing description and the exemplary embodiments described therein.

What is claimed is:

1. An electrical connector for mating with a mating connector, the mating connector having at least one metal elastic sheet, the electrical connector comprising:

an insulating body, having a base, a tongue extending forward from the base, and an upper row of terminals and a lower row of terminals, wherein each of the upper row of terminals has a contact portion exposed from an upper surface of the tongue, and each of the lower row of terminals has a contact portion exposed from a lower surface of the tongue;

a middle shielding sheet, disposed in the tongue, located between the upper row of terminals and the lower row of terminals, and comprising at least one groove exposed from a side of the tongue, and a notch disposed at each of two sides of the middle shielding, wherein the groove is used for being buckled by the metal elastic sheet to stop forward displacement of the metal elastic sheet;

an upper shielding sheet and a lower shielding sheet respectively laminated to the upper surface and the lower surface of the tongue, wherein the upper shielding sheet has two first bending portions disposed at two ends of the upper shielding sheet, the lower shielding sheet has two second bending portions disposed at two ends of the lower shielding sheet, and each of the first bending portions and the second bending portions enters into corresponding one of the notches; and a metal casing, wrapping a periphery of the insulation body, wherein a mating cavity is formed in a peripheral space of the tongue by the metal casing, for the mating connector to be entered therein.

2. The electrical connector of claim 1, wherein the tongue comprises a front surface and two side surfaces located between the upper surface and the lower surface;

wherein the middle shielding sheet comprises a plate portion fixed in the tongue and an extending portion extending out of one of the two side surfaces of the plate portion; and wherein the groove is disposed at the extending portion and located outside the tongue, and the extending portion and the groove are both located in the mating cavity.

3. The electrical connector of claim 2, wherein the extending portion is disposed at each of two sides of the plate portion, the two extending portions symmetrically extend out of the two side surfaces, and the corresponding two grooves are located outside the tongue.

4. The electrical connector of claim 1, wherein the tongue comprises a snap-fit slot corresponding to the groove, and the groove has a buckling wall close to the front of the middle shielding sheet and exposed from the snap-fit slot; and wherein the metal elastic sheet buckles to the buckling wall and partially locates in the snap-fit slot and the groove, and the buckling wall stops forward displacement of the metal elastic sheet.

5. The electrical connector of claim 4, wherein an outline of an inner wall of the groove is the same as that of an inner wall of the snap-fit slot.

6. The electrical connector of claim 1, wherein the groove has a buckling wall close to the front of the middle sheet, the buckling wall is arc-shaped, the metal elastic sheet buckles to the buckling wall, and the buckling wall stops forward displacement of the metal elastic sheet.

7. The electrical connector of claim 1, wherein the tongue comprises a front surface and two side surfaces located between the upper surface and the lower surface; and wherein the middle shielding sheet comprises a plate portion fixed in the tongue, and at least one protecting portion extends out of the front surface of the plate portion.

8. The electrical connector of claim 1, wherein the upper shielding sheet and the lower shielding sheet are mounted and connected to each other by two snap-fit structures, and each of the notches reserves a space for the corresponding snap-fit structure.

9. The electrical connector of claim 1, wherein the middle shielding sheet comprises a mounting portion disposed at a rear segment of the middle sheet and fixed in the base, and the width of the mounting portion is greater than the width of the tongue.

10. The electrical connector of claim 1, wherein the tongue further comprises a front surface and two side surfaces located between the upper surface and the lower surface; and wherein the middle shielding sheet has a plate portion fixed in the tongue, the groove is disposed at the plate portion and located in the tongue, and the groove does not exceed the side surfaces.

* * * * *